US006865140B2

(12) United States Patent
Thomenius et al.

(10) Patent No.: US 6,865,140 B2
(45) Date of Patent: Mar. 8, 2005

(54) MOSAIC ARRAYS USING MICROMACHINED ULTRASOUND TRANSDUCERS

(75) Inventors: Kai Thomenius, Clifton Park, NY (US); Rayette A. Fisher, Niskayuna, NY (US); David M. Mills, Niskayuna, NY (US); Robert G. Wodnicki, Schenectady, NY (US); Christopher Robert Hazard, Schenectady, NY (US); Lowell Scott Smith, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/383,990

(22) Filed: Mar. 6, 2003

(65) Prior Publication Data

US 2004/0174773 A1 Sep. 9, 2004

(51) Int. Cl.[7] ..... H04R 17/00

(52) U.S. Cl. ..... 367/155; 367/163; 367/174; 381/174

(58) Field of Search ..... 367/153, 154, 367/155, 157, 164, 181, 163, 174; 381/169, 174; 600/469

(56) References Cited

U.S. PATENT DOCUMENTS

| | | | |
|---|---|---|---|
| 4,641,660 | A | 2/1987 | Bele |
| 5,146,435 | A | 9/1992 | Bernstein |
| 5,452,268 | A | 9/1995 | Bernstein |
| 5,569,968 | A | 10/1996 | Lal et al. |
| 5,596,222 | A | 1/1997 | Bernstein |
| 5,619,476 | A | 4/1997 | Haller et al. |
| 5,684,324 | A | 11/1997 | Bernstein |
| 5,870,351 | A | 2/1999 | Ladabaum et al. |
| 5,894,452 | A | 4/1999 | Ladabaum et al. |
| 5,982,709 | A | 11/1999 | Ladabaum et al. |
| 6,004,832 | A | 12/1999 | Haller et al. |
| 6,292,435 | B1 | 9/2001 | Savord et al. |
| 6,320,239 | B1 | 11/2001 | Eccardt et al. |
| 6,328,697 | B1 | 12/2001 | Fraser |
| 6,381,197 | B1 | 4/2002 | Savord et al. |
| 6,384,516 | B1 | 5/2002 | Fraser |
| 6,443,901 | B1 | 9/2002 | Fraser |
| 6,461,299 | B1 | 10/2002 | Ladabaum et al. |

FOREIGN PATENT DOCUMENTS

| | | |
|---|---|---|
| WO | WO 00/05001 | 3/2000 |

OTHER PUBLICATIONS

IEEE Transactions on Ultrasonics, Ferroelectrics, and Frequency Control, vol. 45, No. May 3, 1998 Surface Micromachined Capacitive Ultrasonic Transducers Igal ladabaum et al.

Wideband Annular Array Response Dennis R. Dietz et al. Center for Materials Science.

A Compute4r–Controlled Transducer for Real–Time Three Dimensional Imaging D.G. Bailey et al.

*Primary Examiner*—Ian J. Lobo

(74) *Attorney, Agent, or Firm*—Ostrager Chong Flaherty & Broitman P.C.

(57) ABSTRACT

An ultrasound transducer array includes a multiplicity of subelements interconnected by a multiplicity of microelectronic switches, each subelement comprising a respective multiplicity of micromachined ultrasound transducer (MUT) cells. The MUT cells within a particular subelement are hard-wired together. The switches are used to configure the subelements to form multiple concentric annular elements. This design dramatically reduces complexity while enabling focusing in the elevation direction during ultrasonic image data acquisition.

24 Claims, 9 Drawing Sheets

MOSAIC ARRAYS USING MICROMACHINED ULTRASOUND TRANSDUCERS

BACKGROUND OF THE INVENTION

This invention generally relates to mosaic arrays of ultrasound transducer elements and to the use of micromachined ultrasonic transducers (MUTs) in arrays. One specific application for MUTs is in medical diagnostic ultrasound imaging systems.

Conventional ultrasound imaging systems comprise an array of ultrasonic transducers that are used to transmit an ultrasound beam and then receive the reflected beam from the object being studied. Such scanning comprises a series of measurements in which the focused ultrasonic wave is transmitted, the system switches to receive mode after a short time interval, and the reflected ultrasonic wave is received, beamformed and processed for display. Typically, transmission and reception are focused in the same direction during each measurement to acquire data from a series of points along an acoustic beam or scan line. The receiver is dynamically focused at a succession of ranges along the scan line as the reflected ultrasonic waves are received.

For ultrasound imaging, the array typically has a multiplicity of transducers arranged in one or more rows and driven with separate voltages. By selecting the time delay (or phase) and amplitude of the applied voltages, the individual transducers in a given row can be controlled to produce ultrasonic waves that combine to form a net ultrasonic wave that travels along a preferred vector direction and is focused in a selected zone along the beam.

The same principles apply when the transducer probe is employed to receive the reflected sound in a receive mode. The voltages produced at the receiving transducers are summed so that the net signal is indicative of the ultrasound reflected from a single focal zone in the object. As with the transmission mode, this focused reception of the ultrasonic energy is achieved by imparting separate time delay (and/or phase shifts) and gains to the signal from each receiving transducer. The time delays are adjusted with increasing depth of the returned signal to provide dynamic focusing on receive.

The quality or resolution of the image formed is partly a function of the number of transducers that respectively constitute the transmit and receive apertures of the transducer array. Accordingly, to achieve high image quality, a large number of transducers is desirable for both two- and three-dimensional imaging applications. The ultrasound transducers are typically located in a hand-held transducer probe that is connected by a flexible cable to an electronics unit that processes the transducer signals and generates ultrasound images. The transducer probe may carry both ultrasound transmit circuitry and ultrasound receive circuitry.

Recently semiconductor processes have been used to manufacture ultrasonic transducers of a type known as micromachined ultrasonic transducers (MUTs), which may be of the capacitive (MUT) or piezoelectric (pMUT) variety. MUTs are tiny diaphragm-like devices with electrodes that convert the sound vibration of a received ultrasound signal into a modulated capacitance. For transmission the capacitive charge is modulated to vibrate the diaphragm of the device and thereby transmit a sound wave.

One advantage of MUTs is that they can be made using semiconductor fabrication processes, such as microfabrication processes grouped under the heading "micromachining". As explained in U.S. Pat. No. 6,359,367:

> Micromachining is the formation of microscopic structures using a combination or subset of (A) Patterning tools (generally lithography such as projection-aligners or wafer-steppers), and (B) Deposition tools such as PVD (physical vapor deposition), CVD (chemical vapor deposition), LPCVD (low-pressure chemical vapor deposition), PECVD (plasma chemical vapor deposition), and (C) Etching tools such as wet-chemical etching, plasma-etching, ion-milling, sputter-etching or laser-etching. Micromachining is typically performed on substrates or wafers made of silicon, glass, sapphire or ceramic. Such substrates or wafers are generally very flat and smooth and have lateral dimensions in inches. They are usually processed as groups in cassettes as they travel from process tool to process tool. Each substrate can advantageously (but not necessarily) incorporate numerous copies of the product. There are two generic types of micromachining . . . 1) Bulk micromachining wherein the wafer or substrate has large portions of its thickness sculptured, and 2) Surface micromachining wherein the sculpturing is generally limited to the surface, and particularly to thin deposited films on the surface. The micromachining definition used herein includes the use of conventional or known micromachinable materials including silicon, sapphire, glass materials of all types, polymers (such as polyimide), polysilicon, silicon nitride, silicon oxynitride, thin film metals such as aluminum alloys, copper alloys and tungsten, spin-on-glasses (SOGs), implantable or diffused dopants and grown films such as silicon oxides and nitrides.

The same definition of micromachining is adopted herein.

There is a continuing need for improvements in the design of ultrasound transducer arrays. The complexity of today's ultrasound imaging system has to be high in order to achieve excellent image quality. Conventional probes typically have 128 signal processing channels (and for arrays with electronic elevation focusing, an increase by a factor as high as five). Also, the potential for making the correct clinical diagnosis with most imaging modalities (including ultrasound) will benefit by a thinner slice thickness. The implementation of a dynamically focused beam both in elevation and azimuth is very complex and expensive, especially for general imaging (as opposed to echocardiac) applications. Also the volume and power consumed by the electronics is prohibitive to making such a system easily portable.

BRIEF DESCRIPTION OF THE INVENTION

The present invention employs the idea of dividing the active aperture of an ultrasound transducer into a mosaic of very small subelements and then forming elements from these subelements by interconnecting them with electronic switches. These elements can be "moved" electronically along the surface of the mosaic array to perform scanning by changing the switch configuration. Other element configurations permit beamsteering, which will provide the ability to acquire volumetric data sets. A configuration of multiple concentric annular elements provides optimal acoustic image quality by matching the element shapes to the acoustic phase fronts. One aspect of the invention is the reconfigurability of the resulting array.

It is these capabilities to both reconfigure elements and to have elements match phase fronts that significantly reduce the number of elements (or channels) needed to achieve high-end system image quality. With fewer channels the number of signals that need to be processed by beamforming electronics is also dramatically reduced. Therefore the volume and power consumption of system electronics for a mosaic array is compatible with highly portable ultrasound systems.

One aspect of the invention is a mosaic array comprising a multiplicity of subelements, each of the subelements comprising a respective multiplicity of micromachined ultrasound transducer (MUT) cells, and each MUT cell comprising a top electrode and a bottom electrode. The top electrodes of the MUT cells making up any particular subelement are hard-wired together, while the bottom electrodes of those same MUT cells are likewise hard-wired together.

Another aspect of the invention is an ultrasound transducer array comprising a multiplicity of subelements interconnected by a multiplicity of microelectronic switches, each subelement comprising a respective multiplicity of MUT cells, and each MUT cell within a particular subelement being hard-wired together.

A further aspect of the invention is a method of making an ultrasound transducer, comprising the following steps: fabricating a substrate having a multiplicity of microelectronic switches therein; and micromachining a multiplicity of MUT cells on the substrate, the MUT cells being interconnected in clusters, each cluster of interconnected MUT cells being connected to a respective one of the microelectronic switches.

Yet another aspect of the invention is an ultrasound transducer comprising: a multiplicity of MUT cells, each MUT cell comprising a respective top electrode and a respective bottom electrode, wherein the top electrodes of the MUT cells are hard-wired together and the bottom electrodes of the MUT cells are hard-wired together; a microelectronic switch having an output terminal connected to the interconnected top electrodes or to the interconnected bottom electrodes; and a driver circuit having an output terminal connected to an input terminal of the microelectronic switch for driving the multiplicity of MUT cells to generate ultrasound waves when the microelectronic switch is turned on.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
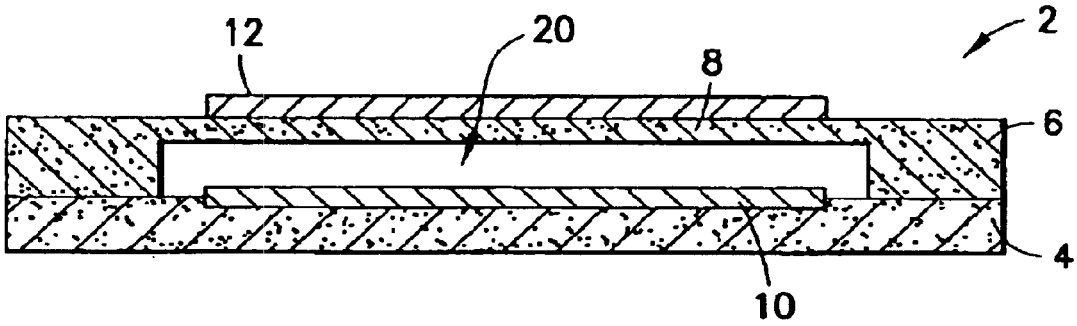
FIG. 1 is a drawing showing a cross-sectional view of a typical cMUT cell.

The innovation disclosed here is a unique method of implementing a mosaic array with micromachined ultrasound transducers (MUTs). For the purpose of illustration, various embodiments of the invention will be described that utilize capacitive micromachined ultrasonic transducers (cMUTs). However, it should be understood that the aspects of the invention disclosed herein are not limited to use of cMUTs, but rather may also employ pMUTs or even diced piezoceramic arrays where each of the diced subelements are connected by interconnect means to an underlying switching layer.

cMUTs are silicon-based devices that comprise small (e.g., 50 $\mu$m) capacitive "drumheads" or cells that can transmit and receive ultrasound energy. Referring to FIG. 1, a typical MUT transducer cell 2 is shown in cross section. An array of such MUT transducer cells is typically fabricated on a substrate 4, such as a silicon wafer. For each MUT transducer cell, a thin membrane or diaphragm 8, which may be made of silicon nitride, is suspended above the substrate 4. The membrane 8 is supported on its periphery by an insulating support 6, which may be made of silicon oxide or silicon nitride. The cavity 20 between the membrane 8 and the substrate 4 may be air- or gas-filled or wholly or partially evacuated. A film or layer of conductive material, such as aluminum alloy or other suitable conductive material, forms an electrode 12 on the membrane 8, and another film or layer made of conductive material forms an electrode 10 on the substrate 4. Alternatively, the electrode 10 can be embedded in the substrate 4.

The two electrodes 10 and 12, separated by the cavity 20, form a capacitance. When an impinging acoustic signal causes the membrane 8 to vibrate, the variation in the capacitance can be detected using associated electronics (not shown in FIG. 1), thereby transducing the acoustic signal into an electrical signal. Conversely, an AC signal applied to one of the electrodes will modulate the charge on the electrode, which in turn causes a modulation in the capacitive force between the electrodes, the latter causing the diaphragm to move and thereby transmit an acoustic signal.

In operation, the MUT cell typically has a dc bias voltage $V_{bias}$ that is significantly higher than the time-varying voltage v(t) applied across the electrodes. The bias attracts the top electrode toward the bottom through coulombic force. In this heavily biased case, the MUT drumheads experience a membrane displacement u given as follows:

$$u(t) \approx \frac{\varepsilon}{d^2} * V_{bias} * v(t) \quad (1)$$

where d is the distance between the electrodes or plates of the capacitor, and å is the effective dielectric constant of the cell. The sensitivity of the MUT cell has been found to be the greatest when the bias voltage is high and electrodes are closer together.

Due to the micron-size dimensions of a typical MUT, numerous MUT cells are typically fabricated in close proximity to form a single transducer element. The individual cells can have round, rectangular, hexagonal, or other peripheral shapes. Hexagonal shapes provide dense packing of the MUT cells of a transducer element. The MUT cells can have different dimensions so that the transducer element will have composite characteristics of the different cell sizes, giving the transducer a broadband characteristic.

MUT cells can be hard-wired together in the micromachining process to form subelements, i.e., clusters of individual MUT cells grouped in some presumably intelligent fashion (the term "subelement" will be used in the following to describe such a cluster). These subelements will be interconnected by microelectronic switches (as opposed to hard-wired) to form larger elements, such as annuli, by placing such switches within the silicon layer upon which the MUT subelements are built. This construction is based on semiconductor processes that can be done with low cost in high volume.

There are many methods of designing the mosaic to get the best acoustic performance. For example, one can match phase fronts on both transmit and receive; provide a gap between adjacent subelements to reduce element-to-element cross talk; choose various subelement patterns to form a tessellation of the mosaic grid; and choose various elemental patterns for transmit and receive for maximal acoustic performance in specific applications.

In accordance with the embodiments disclosed herein, the transducer is fabricated using an array of MUT subelements that can be interconnected in numerous ways to provide specific acoustic output with regards to beam direction, focal location, and minimal sidelobes and grating lobes.

Figure 2:
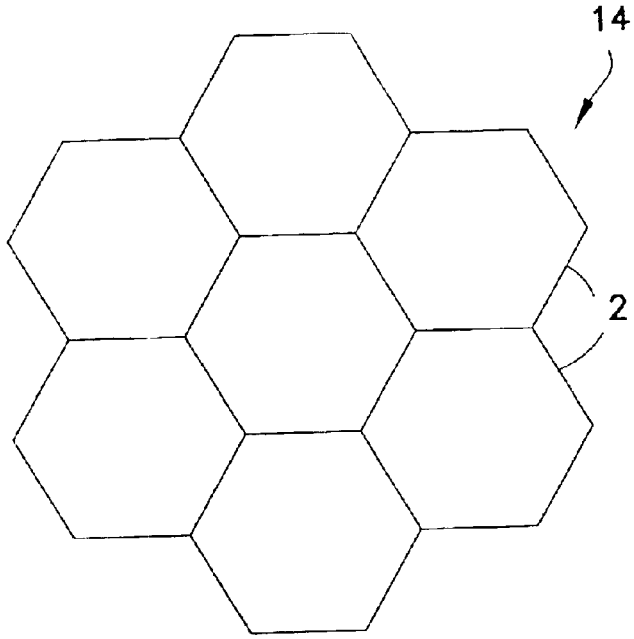
FIG. 2 is a drawing showing a "daisy" subelement formed from seven hexagonal MUT cells having their top and bottom electrodes respectively hard-wired together.

For the purpose of illustration, FIG. 2 shows a "daisy" subelement 14 made up of seven hexagonal MUT cells 2: a central cell surrounded by a ring of six cells, each cell in the ring being contiguous with a respective side of the central cell and the adjoining cells in the ring. The top electrodes of each cell are hardwired together. Similarly, the bottom electrodes of each cell are hardwired together, forming a seven-times-larger capacitive subelement.

Figure 3:
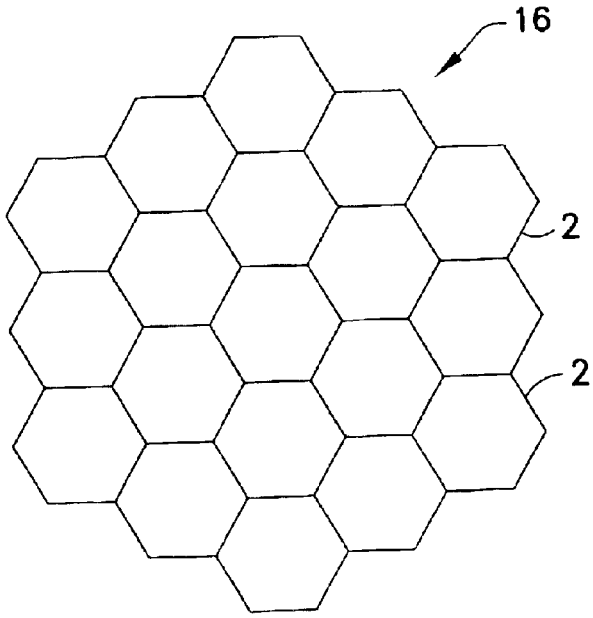
FIG. 3 is a drawing showing a "hexagonal" subelement formed from 19 hexagonal MUT cells having their top and bottom electrodes respectively hard-wired together.

An alternative "hexagonal" subelement 16 is shown in FIG. 3 and is made up of 19 MUT cells. The top electrodes of the cells in each group are hardwired together; similarly, the bottom electrodes of the cells in each group are connected, thus forming a larger capacitive subelement. Since the MUT cell can be made very small, it is possible to achieve very fine-pitch mosaic arrays.

Figure 4:
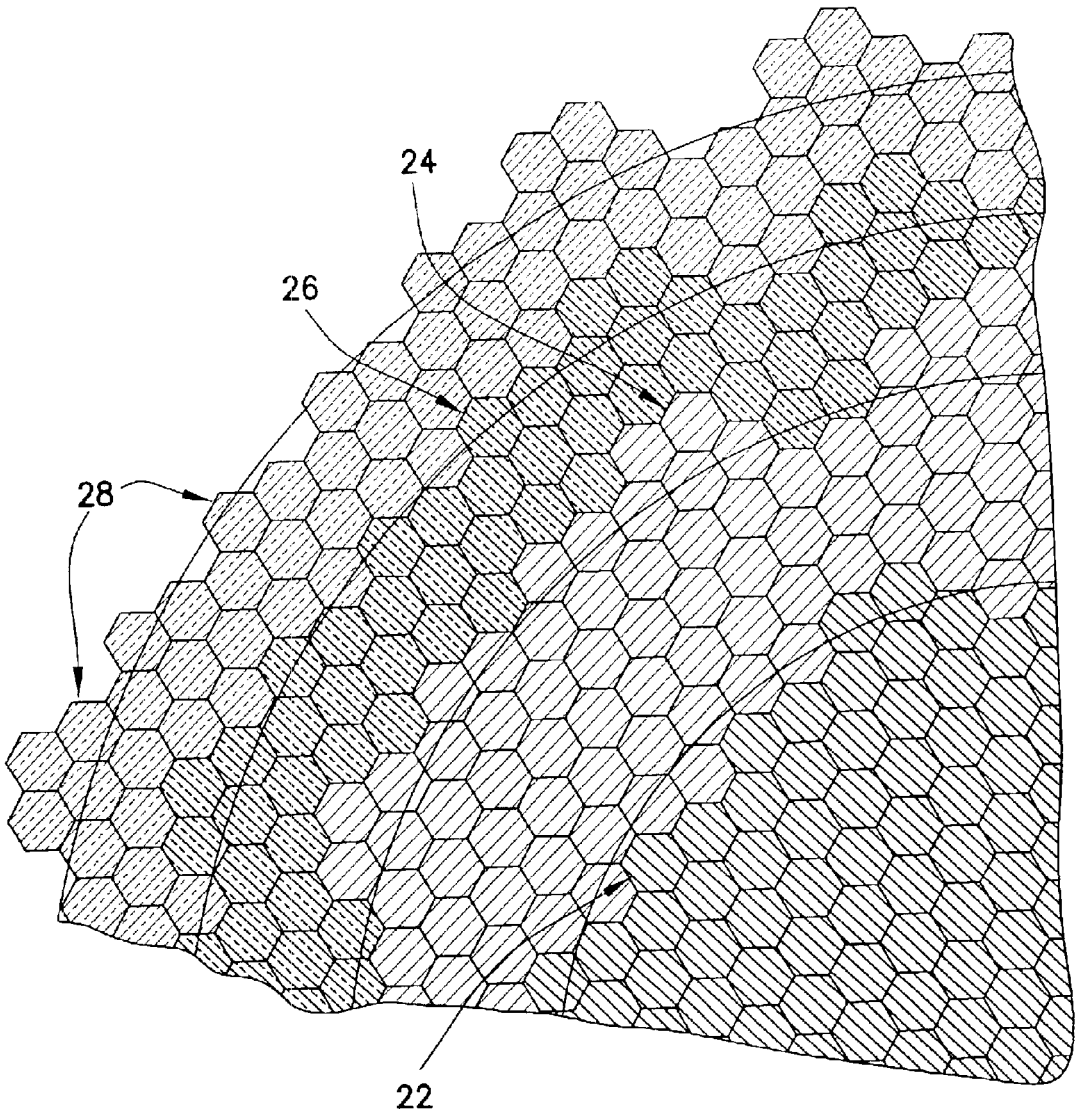
FIG. 4 is a drawing showing a sector of a mosaic array comprising four annular elements in accordance with one embodiment of the invention, each element consisting of a tessellation of "daisy" subelements configured to have approximately equal area per element.
Figure 5:
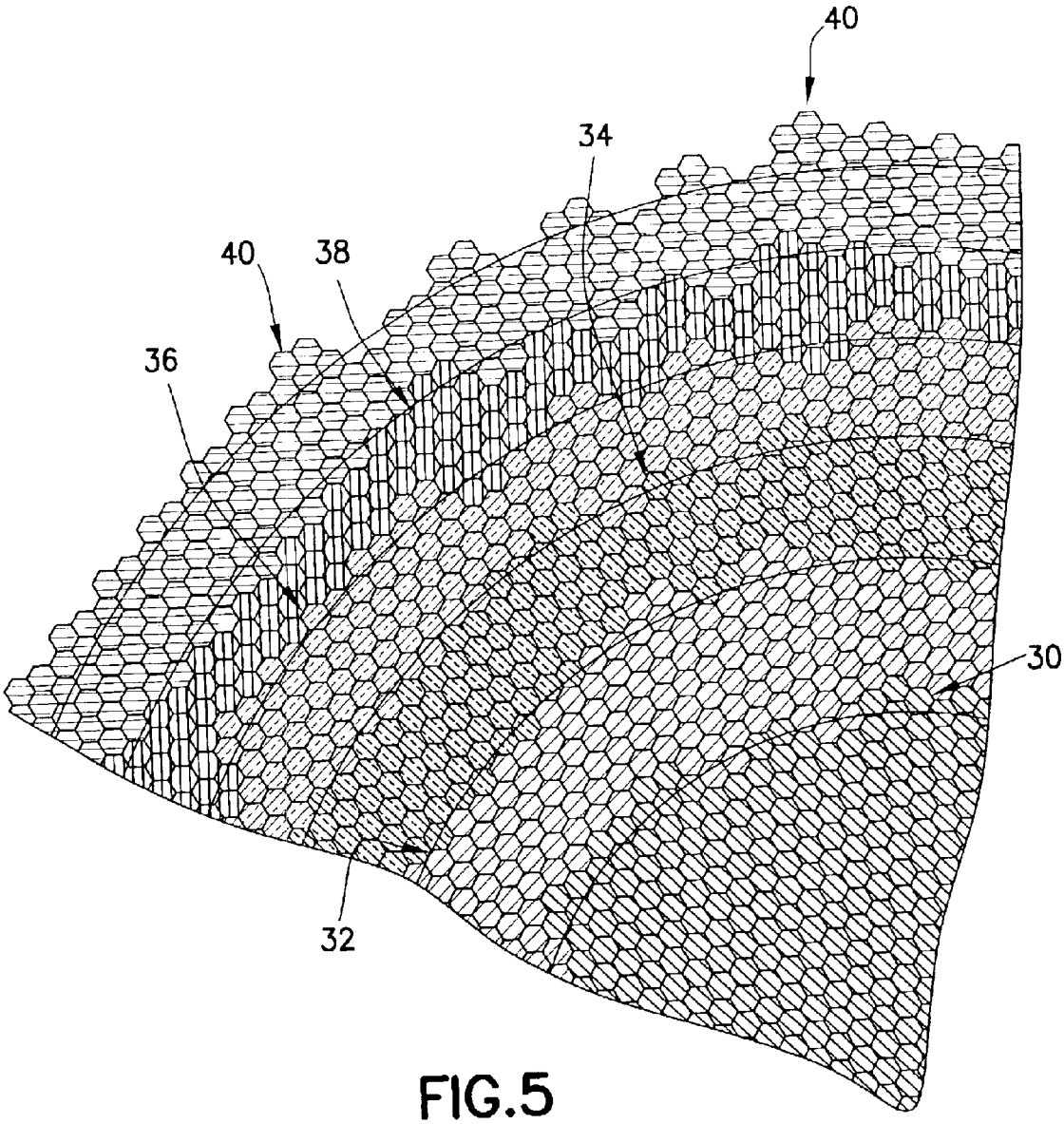
FIG. 5 is a drawing showing a sector of a mosaic array comprising six annular elements in accordance with another embodiment of the invention, each element consisting of a tessellation of "daisy" subelements configured to have approximately equal area per element.

There are numerous ways in which one can form transducer arrays using MUT cells and subelements that fall within the scope of the present invention. FIGS. 4 and 5 show examples of tessellations of subelements to form mosaic arrays. In the embodiment shown in FIG. 4, four approximately annular elements (referenced by numerals 22, 24, 26 and 28 respectively), each comprising a tessellation of "daisy" subelements (seven MUT cells hardwired together per subelement), are configured to have approximately equal area per element. In the embodiment shown in FIG. 5, six approximately annular elements (referenced by numerals 30, 32, 34, 36, 38 and 40 respectively), each comprising a tessellation of "daisy" subelements, are configured to have approximately equal area per element. The tessellation in each case can be made up of multiple subelement types. The array pattern need not be a tessellation, but can have areas without acoustical subelements. For instance, there could be vias to bring top electrode connections of the MUT subelement or cells below the array.

The configurations of the invention can be changed to optimize various acoustic parameters such as beamwidth, sidelobe level, or depth of focus. Alternatively, the subelements could be grouped to form one aperture for the transmit operation and immediately switched to another aperture for the receive portion. While FIGS. 4 and 5 show approximately annular elements, other configurations can be implemented, for example, non-continuous rings, octal rings, or arcs. The choice of pattern will depend on the application needs.

Figure 6:
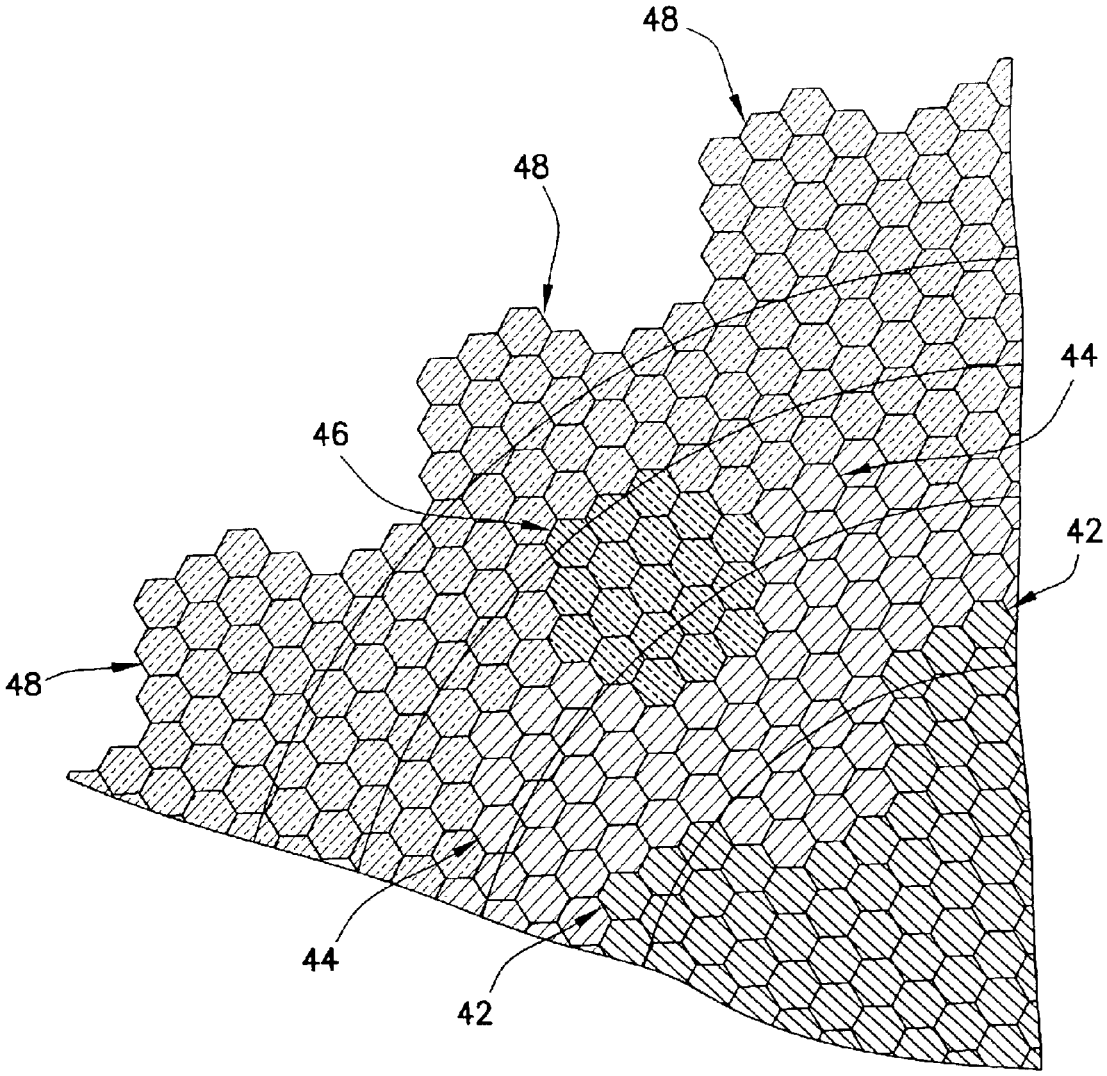
FIG. 6 is a drawing showing a sector of a mosaic array comprising four elements in accordance with yet another embodiment of the invention, each element consisting of a tessellation of "hexagonal" subelements.
Figure 7:
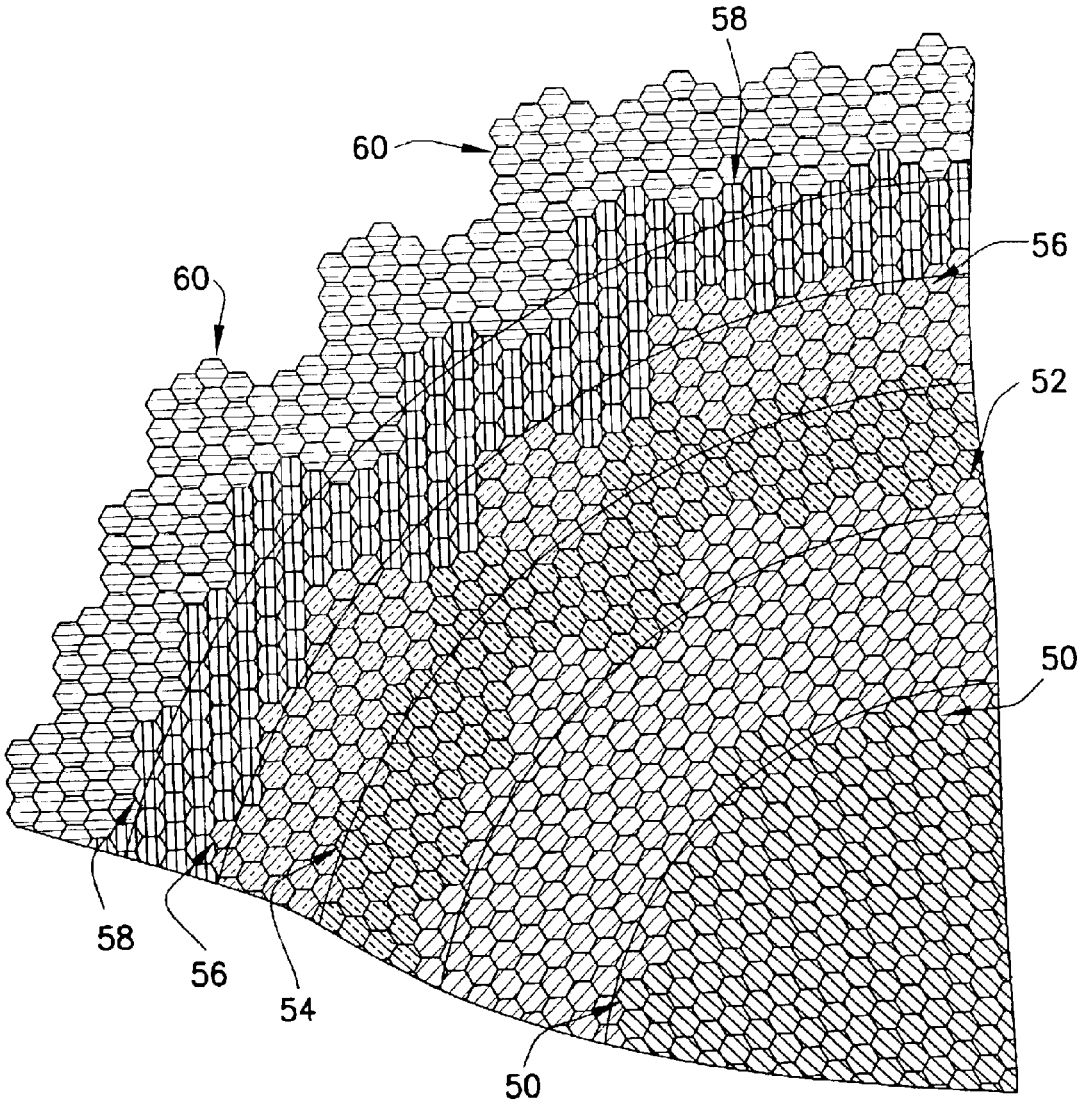
FIG. 7 is a drawing showing a sector of a mosaic array comprising six elements in accordance with a further embodiment of the invention, each element consisting of a tessellation of "hexagonal" subelements.

FIGS. 6 and 7 illustrate some examples of elemental patterns comprising a tessellation of "hexagonal" subelements. The embodiment shown in FIG. 6 has four elements (referenced by numerals 42, 44, 46 and 48 respectively), each element comprising a tessellation of "hexagonal" subelements (19 MUT cells hardwired together per subelement). The elements are not circular. In particular, the third element is a non-continuous ring or, more precisely, a plurality of "hexagonal" subelements circumferentially distributed at equal angular intervals. The embodiment shown in FIG. 7 has six elements (referenced by numerals 50, 52, 54, 56, 58 and 60 respectively), each element consisting of a tessellation of "hexagonal" subelements. In this embodiment, the fourth element is a non-continuous ring, while the first (i.e., central) element is hexagonal rather than circular.

It should be understood that the patterns shown in FIGS. 4–7 are for illustrative purposes only. Numerous other patterns can be defined and this disclosure is not intended to limit the innovation to the ones explicitly shown.

In the case of mosaic annular arrays, the annuli enable a dramatic reduction in the number of signals that have to be processed by the beamforming electronics. For example, if the cMUT cells are distributed into an eight-element annular array, this means that the beamforming electronics will have to deal only with the eight signals output by those annuli. This is in sharp contrast to the case of conventional probes in which the number of signal processing channels is typically 128 (and for arrays with electronic elevation focusing, that number multiplied by a factor of five).

Figure 8:
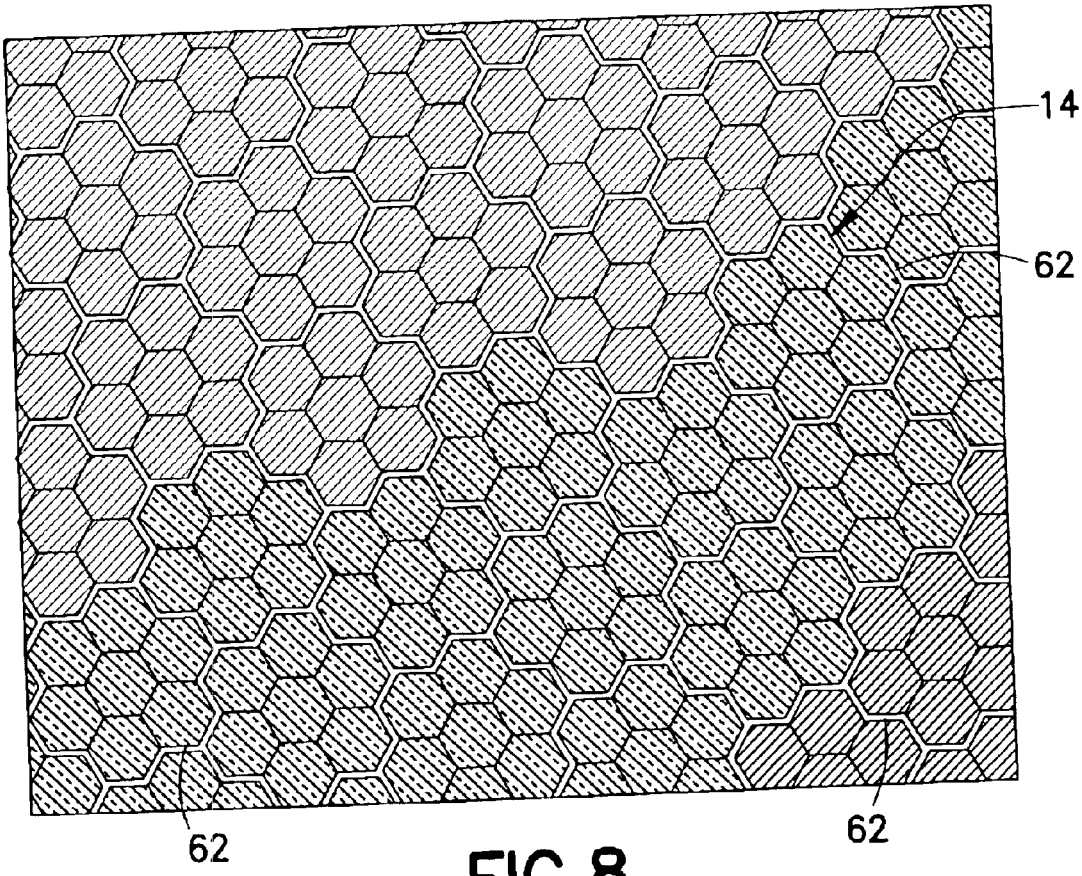
FIG. 8 is a drawing showing a tessellation of "daisy" subelements separated by gaps for reduction of signal cross talk
Figure 9:
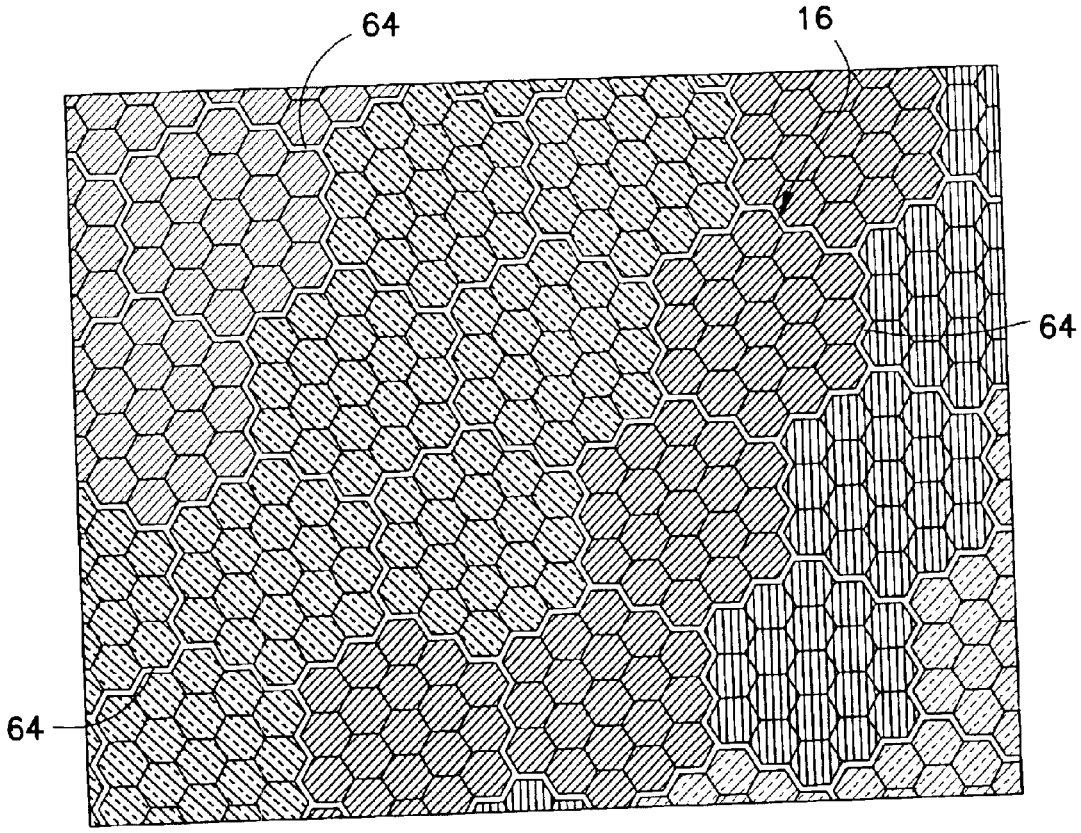
FIG. 9 is a drawing showing a tessellation of "hexagonal" subelements separated by gaps for reduction of signal cross talk

In accordance with a further aspect of the invention, cross talk between elements in a reconfigurable array can be reduced by introducing a small gap between subelements. FIG. 8 shows a tessellation of "daisy" subelements 14 wherein each "daisy" subelement is separated from adjacent subelements by a gap 62. FIG. 9 shows a tessellation of "hexagonal" subelements 16 wherein each "hexagonal" subelement is separated from adjacent subelements by a gap 64. For further cross-talk reduction, a trench into the silicon substrate around each subelement could be implemented.

The subelements ("daisy", "hexagonal", or other shape) may be connected dynamically using switches beneath the array, making possible the formation of arbitrary elemental patterns or, in other words, a reconfigurable array. While these switches can be separately packaged components, it is possible to actually fabricate the switches within the same semiconductor substrate on which the MUT array is to be fabricated. The micromachining process used to form the MUT array will have no detrimental effect on the integrated electronics.

In accordance with one aspect of the invention, it is possible to reduce the number of high-voltage switches by using pulser circuits that may be made small due to the very limited current the high-impedance MUTs require.

Each MUT subelement may be driven by a high-voltage switching circuit comprising two DMOS FETs that are connected back to back (source nodes shorted together; see switches X1–X3 in FIG. 10) to allow for bipolar operation. Such a switching circuit is disclosed in pending U.S. patent application Ser. No. 10/383,990 entitled "Integrated High-Voltage Switching Circuit for Ultrasound Transducer Array". In that switching circuit, current flows through the switch terminals whenever both FETs are turned on. To turn on the switch, the gate voltage of these devices must be greater than their source voltage by a threshold voltage. Above the threshold voltage, switch on resistance varies inversely with the gate voltage. Since the source voltage will be close to the drain voltage (for low on resistance and low current), the source voltage will track the ultrasound transmit pulse voltage. In order for the gate-source voltage to remain constant, the gate voltage must also track the transmit pulse voltage. This can be achieved by isolating the source and gate from the switch control circuitry and providing a fixed potential at the gate with reference to the source. This is preferably achieved using dynamic level shifters.

U.S. patent application Ser. No. 10/383,990 discloses a turn-on circuit comprising a high-voltage PMOS transistor whose drain is connected to a common gate of the DM0S FETs via a diode. The gate of the PMOS transistor receives the switch gate turn-on voltage $V_P$. The source of the PMOS transistor is biased at a global switch gate bias voltage (nominally 5 V). In order to turn on the switch, the gate voltage-$V_P$ of the PMOS transistor is transitioned from high (5 V) to low (0 V), causing the global bias voltage to be applied through the PMOS transistor to the shared gate terminal of the DMOS FETs. The diode is provided to prevent the PMOS transistor from turning on when the switch gate voltage $V_P$ drifts above the global switch gate bias voltage. Once the switch gate voltage $V_P$ has reached the switch gate bias voltage, the parasitic gate capacitance of the DMOS FETs will retain this voltage. For this reason, once the gate voltage $V_P$ has stabilized, the PMOS transistor can be turned off to conserve power. The fact that the switch ON state is effectively stored on the switch gate capacitance means that the switch has its own memory.

Figure 10:
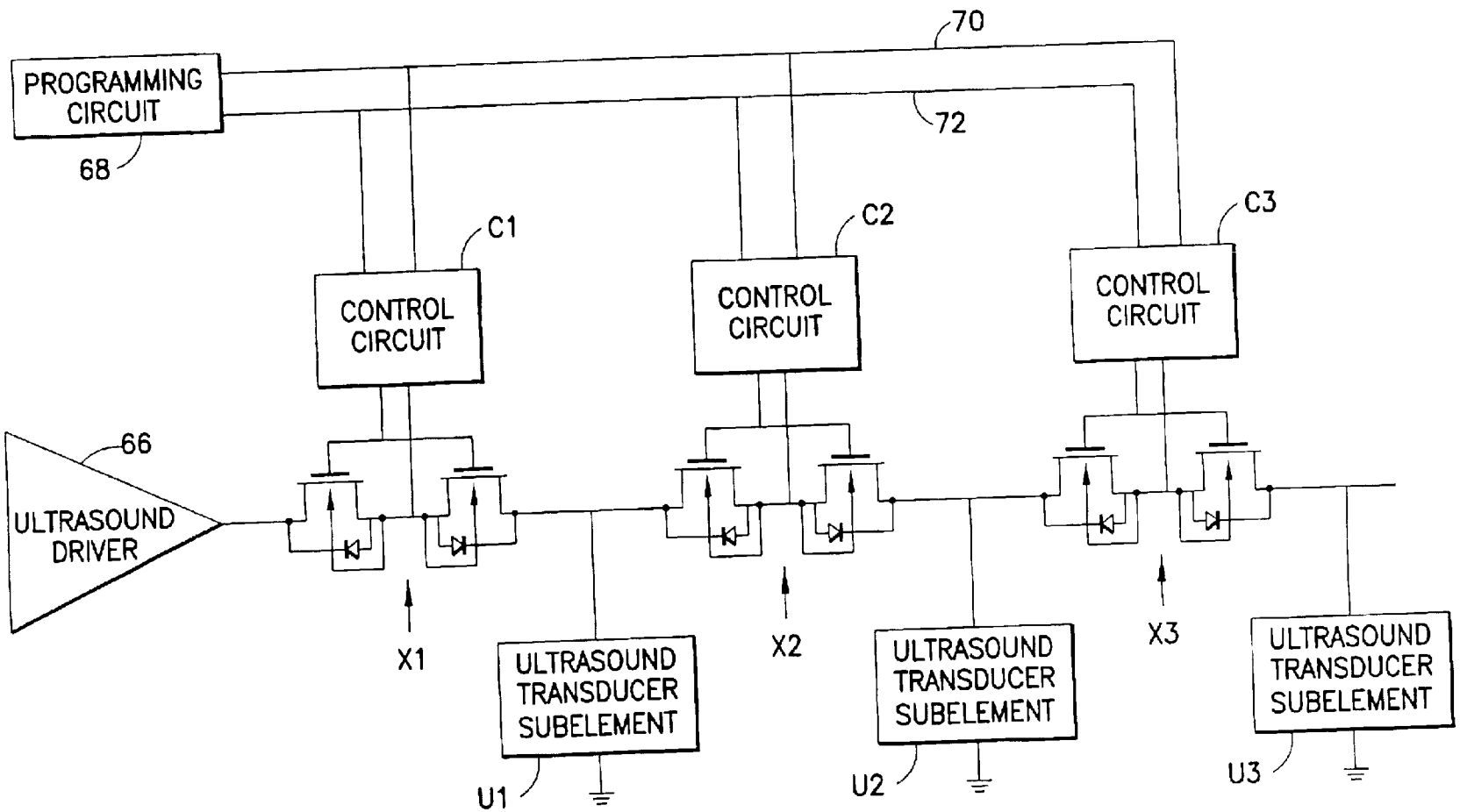
FIG. 10 is a schematic of a cascade of high-voltage switching circuits for selectively driving ultrasound transducers of a mosaic array in accordance with one embodiment of the invention.

This switching circuit can be used as part of a cascade of switches, as shown in FIG. 10 (taken from the above-cited patent application, Ser. No. 10/383,990).

The exemplary cascade shown in FIG. 10 comprises three switches X1, X2 and X3 connected in series, although it should be understood that more than three switches can be cascaded in the manner shown. The states of the switches X1 through X3 are controlled by respective switch control circuits C1 through C3. There is a digital circuit (not shown) that controls the gate turn-off voltage $V_N$ and the gate turn-on voltage $V_P$. This digital circuit has local memory of the state of the switch. An external control system (programming circuit 68 in FIG. 10) programs all of the switch memories to be in either the ON, OFF or NO_CHANGE state. Then a global select line 70 (see FIG. 10) is used to apply the state to the actual switch control circuit. So until the select line is actuated, $V_N$ and $V_P$ are both zero. In this state the switch itself retains its last state. When the global select line 70 is actuated, the stored switch state is transferred to the switch itself by either bringing $V_N$ high (turn off the switch), $V_P$ low (turn on the switch), or $V_N$ and $V_P$ both low (no change to the switch state). The global switch gate bias voltage terminals of each switch X1–X3 in FIG. 10 are connected to a bus 72. The global select line 70, in conjunction with the global switch gate bias voltage bus 72, allow the turn-on voltage of each switch X1–X3 to be programmed independently. More specifically, each switch can be programmed with its own unique gate turn-on voltage that can be used to adjust the switch-on resistances of all switches in the array to correct for variation due to processing.

Still referring to FIG. 10, a first ultrasound transducer U1 can be driven by the ultrasound driver 66 when switch X1 is turned on; a second ultrasound transducer U2 can be driven by the ultrasound driver 10 when switches X1 and X2 are both turned on; and a third ultrasound transducer U3 can be driven by the ultrasound driver 10 when switches X1, X2 and X3 are all turned on. Each ultrasound transducer can be a subelement of one of the types disclosed herein.

I. Applications for Reconfigurable MUT-Based Mosaic Array

The present invention exploits the concept of reconfigurability of arrays. The following examples are not intended to cover the entire set of possibilities that can be taken advantage of but rather are given for illustrative purposes.

a. Annular Arrays

With known non-mosaic annular arrays, the usual custom is to build them with an equal-area approximation in which the center element and the annuli all have an equal area. This approach forces the phase shift across each element to be constant. It also makes all the element impedances uniform, thereby giving equal loading to the circuitry driving and receiving from them. This helps the spectral content of each element to be nearly uniform and therefore maximizes the coherence of the transmit and receive beamformation processes.

However, computer simulations show that the equal-area approach limits the near-field performance of the array due to limited number of elements that come into play in the near field. One alternative design is called the constant f-number design, which is intended for flat (non-prefocused) annular arrays. With this approach there is an attempt to maintain a constant f-number over the range of interest until one runs out of aperture. These designs and other variants are readily implemented with the reconfigurable arrays of MUT subelements disclosed herein.

b. Non-Annular Arrays

It should be recognized that the reconfigurability of MUTs permits great generality in the shape and size of a mosaic array element. Certain clinical applications may call for other configurations such as elliptical designs (in case elevation lensing is used) or possible sparse array designs.

c. Different Configurations on Transmit Versus Receive

Integrated electronics within the MUT array substrate provide the capability to switch the array elemental pattern or configuration quickly. One advantage this brings to bear on acoustic performance is the ability to have a different aperture for transmit than for receive. On transmit the optimal aperture for a fixed focal depth can be configured, whereas on receive an aperture appropriate for a dynamically changing focus (or aperture or apodization) can be implemented. This is not limited to changing the size of the aperture (e.g., all system channels can be used on both transmit and receive).

d. Beam Steering

A reconfigurable array allows for the possibility of steering beams by grouping together those subelements that have similar delay values for the given beam. While a broadside beam will have groupings shaped like annular rings, beams steered away from the perpendicular have arc-shaped groupings.

The beam can be steered three-dimensionally, that is, in both the azimuthal and elevational directions. The added value of the reconfigurable design is that these steered beams can be accomplished with fewer system channels since a typical phased array heavily oversamples the acoustic field at shallow steering angles. Thus beam steering can be achieved with a limited number of channels by effectively grouping together elements in the mosaic design according to the time delay needed. The number of discrete delays needed is related to the level of sidelobes that arise as one increases the coarseness of the spatial sampling.

II. Acoustic Performance Enhancements a. Subelement-to-Subelement Bias Voltage Variation It is well known that abrupt changes in amplitude at the transmitting aperture generate higher-amplitude sidelobes via a Gibbs phenomenon-related process. With one-dimensional arrays, most manufacturers apply a weighting (or apodization) to reduce these sidelobes. With mosaic annular arrays that transmit in a perpendicular direction with respect to the surface of the array, apodization can be applied to the individual rings of the array. This is no longer possible with a beam-steered mosaic annular array since a constant amplitude would have to be applied to each of the arcs and these arcs end at the edges of the mosaic annular array aperture. To get around this problem, the bias voltage across the aperture can be modified to generate a spherical (or other shape) modulation across the MUT cells and thereby vary the beamformation process as desired. In general this will mean controlling the bias voltage across the active aperture. Once again, the discreteness of this control will be determined by the desired beam quality and the circuit complexity that can be tolerated. Using the bias voltage to establish the form of apodization, even if one is using annular rings, there is more control over the apodization because the shape of the apodizing function is determined by the subelements, not the annular rings.

Furthermore, due to process variations the acoustic sensitivity of subelements may not be uniform across the array. Because sensitivity is dependent on bias voltage, independently adjusting this voltage for each subelement can compensate for the sensitivity variation.

b. Adaptive Acoustics

The quality of the beam formation can be examined periodically by isolating the echoes received by any subelement (or group of subelements) in the array and comparing the temporal relation of the echoes with those of the sum from all the mosaic array elements (the beamsum). That subelement (or group) can then be reassigned to a different annulus or arc depending on its phase or time delay relation to the beamsum signal.

c. Harmonics

The mosaic arrays disclosed herein also provide the benefits of high bandwidth. It is expected that the use of mosaic arrays, especially in the mosaic annular configuration, will yield higher amounts of harmonic energy than achievable with rectangular apertures due to the greater control over the acoustic field that is possible. It is further anticipated that this additional harmonic energy will be more readily detected due to the wide bandwidth of MUTs.

With respect to broad bandwidth performance, the likelihood of third harmonic imaging is far superior with the mosaic array approach disclosed herein (current systems only use the second harmonic).

Moreover, the mosaic arrays disclosed herein provide beam shape advantages. Techniques such as tissue characterization will gain directly from the use of wide-bandwidth devices such as MUTs. This is because the tissue characteristics are better sampled due to the excellent resolution.

In summary, the invention disclosed herein provides superior beam performance, including reduced slice thickness, dynamically focused beams in elevation and reconfigurability of the array to improve acoustic performance or for specific clinical situations. The invention also reduces system complexity arising out of channel count decreases, leading to reduced power consumption, reduced cost and increased portability.

The combination of MUT technology with mosaic arrays provides the capability to reconfigure fine-pitch elements to match acoustic phase fronts necessary for excellent image quality across many different ultrasound applications. The MUT cells are also nonresonant structures. As a consequence, they are able to operate over a far wider frequency range than conventional piezoceramic arrays. The mosaic array technology will provide real-time two-dimensional and electronically driven three-dimensional imaging with much finer beam shaping and control than present state-of-the-art arrays.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A mosaic array comprising a multiplicity of subelements, a multiplicity of switches, each of said switches being connected to at least one of said subelements, and a programming circuit that controls said multiplicity of switches, each of said subelements comprising a respective multiplicity of micromachined ultrasound transducer (MUT) cells, and each NUT cell comprising a top electrode and a bottom electrode, wherein the top electrodes of the MUT cells making up any particular subelement are connected together by connections that are not switchably disconnectable, and the bottom electrodes of those same MUT cells are connected together by connections that are not switchably disconnectable, wherein said programming circuit controls said switches to form a first ring-shaped element comprising a first set of said subelements.

2. The mosaic array as recited in claim 1, wherein each subelement comprises a respective group of seven MUT cells arranged in a daisy configuration.

3. The mosaic array as recited in claim 1, wherein each subelement comprises a respective group of 19 MUT cells arranged in a hexagonal configuration.

4. The mosaic array as recited in claim 1, wherein each subelement comprises a respective group of N MUT cells arranged in a predetermined pattern, wherein N is an integer greater than unity.

5. The mosaic array as recited in claim 1, wherein adjacent subelements are separated by gaps sufficient to reduce cross talk.

6. The mosaic array as recited in claim 1, further comprising a semiconductor substrate, said switches being fabricated within said semiconductor substrate and said cMUT cells being fabricated on said semiconductor substrate.

7. The mosaic array as recited in claim 1, wherein said programming circuit controls said switches so that the aperture on transmit is different than the aperture on receive.

8. The mosaic array as recited in claim 1, wherein said programming circuit controls said switches so that said first ring-shaped element is a generally annular ring.

9. The mosaic array as recited in claim 1, wherein said programming circuit controls said switches so that said first ring-shaped element is a non-annular ring.

10. The mosaic array as recited in claim 1, wherein said programming circuit controls said switches so that said first set of subelements of said first ring-shaped element are circumferentially distributed along a circle at equal angular intervals.

11. The mosaic array as recited in claim 1, wherein said programming circuit controls said switches to form a second ring-shaped element comprising a second set of said subelements, said first ring-shaped element being surrounded by said second ring-shaped element.

12. The mosaic array as recited in claim 11, wherein said programming circuit controls said switches to form a third ring-shaped element comprising a third set of said subelements, said second ring-shaped element being surrounded by said third ring-shaped element.

13. The mosaic array as recited in claim 1, wherein said programming circuit controls said switches so that switched-on subelements having similar delay values produce a steered beam.

14. The mosaic array as recited in claim 1, wherein said programming circuit modifies the bias voltage across the active aperture to generate a shaped modulation across said MUT cells.

15. The mosaic array as recited in claim 1, wherein said programming circuit independently adjusts the bias voltage for each subelement to compensate for sensitivity variation.

16. An ultrasound transducer array comprising a multiplicity of subelements interconnected by a multiplicity of microelectronic switches and programming means for interconnecting selected subelements to form respective ring-shaped elements, each ring-shaped element comprising a respective set of said subelements, each subelement comprising a respective multiplicity of MUT cells, and each MUT cell within a particular subelement being connected together by connections that are not switchably disconnectable.

17. The array as recited in claim 16, wherein said respective ring-shaped elements form multiple concentric annuli of an electronically formed annular array.

18. The array as recited in claim 17, wherein said electronically formed annular array is moved, under electronic control, across said transducer array.

19. The array as recited in claim 16, wherein the borders of said annuli are changed electronically in response to the temporal relationship between the echoes received by said subelements and the total beamsum signal of an electronically formed annular array.

20. The array as recited in claim 16, wherein said subelements are interconnected in a first configuration during transmit and a second configuration during receive, said first and second configurations being different.

21. The array as recited in claim 16, wherein each subelement comprises a respective group of seven MUT cells arranged in a daisy configuration.

22. The array as recited in claim 16, wherein each subelement comprises a respective group of 19 MUT cells arranged in a hexagonal configuration.

23. The array as recited in claim 16, wherein each subelement comprises a respective group of N MUT cells arranged in a predetermined pattern, wherein N is an integer greater than unity.

24. The array as recited in claim 16, wherein adjacent subelements are separated by gaps sufficient to reduce cross talk.

* * * * *

UNITED STATES PATENT AND TRADEMARK OFFICE

CERTIFICATE OF CORRECTION

PATENT NO. : 6,865,140 B2
DATED : March 8, 2005
INVENTOR(S) : Kai Thomenius et al.

It is certified that error appears in the above-identified patent and that said Letters Patent is hereby corrected as shown below:

Column 10,
Lines 40-54, correct to read:

1. A mosaic array comprising a multiplicity of subelements, a multiplicity of switches, each of said switches being connected to al least one of said subelements, and a programming circuit that controls said multiplicity of switches, each of said subelements comprising a respective multiplicity of micromachined ultrasound transducer (MUT) cells, and each MUT cell comprising a top electrode and a bottom electrode, wherein the top electrodes of the MUT cells making up any particular subelement are connected together by connections that are not switchably disconnectable, and the bottom electrodes of those same MUT cells are connected together by connections that are not switchably disconnectable, wherein said programming circuit controls said switches to form a first ring-shaped element comprising a first set of said subelements.

Signed and Sealed this

Seventh Day of February, 2006

JON W. DUDAS
*Director of the United States Patent and Trademark Office*